US006314929B1

(12) United States Patent
Maeyama et al.

(10) Patent No.: US 6,314,929 B1
(45) Date of Patent: Nov. 13, 2001

(54) VALVE TIMING CONTROL DEVICE OF INTERNAL COMBUSTION ENGINE

(75) Inventors: Akinobu Maeyama; Hideyuki Miyasaka; Hiroaki Imai, all of Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/651,286

(22) Filed: Aug. 30, 2000

(30) Foreign Application Priority Data

Oct. 5, 1999 (JP) ..... 11-284270

(51) Int. Cl.[7] ..... F01L 1/34

(52) U.S. Cl. ..... 123/90.17; 74/568 R; 464/2; 464/160

(58) Field of Search ..... 123/90.15, 90.17, 123/90.31; 74/568 R; 464/1, 2, 160

(56) References Cited

U.S. PATENT DOCUMENTS 5,875,750 * 3/1999 Iwasaki et al. ..... 123/90.17
6,129,063 * 10/2000 Niethammer et al. ..... 123/90.17
6,186,103 * 2/2001 Schafer et al. ..... 123/90.17

FOREIGN PATENT DOCUMENTS 9-324611 12/1997 (JP) .

* cited by examiner

*Primary Examiner*—Weilun Lo
(74) *Attorney, Agent, or Firm*—Foley & Lardner

(57) ABSTRACT

An internal combustion engine has a sprocket driven by a timing chain in synchronization with the engine rotation and a camshaft for driving intake or exhaust valves. A valve timing control device of the engine comprises a first rotating member on which the sprocket is integrally formed; a second rotating member capable of making a relative rotation to the first rotating member and rotated together with the camshaft; a plurality of working fluid chambers defined between the first and second rotating members; and a charging/discharging means for charging and discharging a working fluid to and from the working fluid chambers to induce the relative rotation between the first and second rotating members. The sprocket and at least a base part of the first rotating member on which the sprocket is integrally formed are constructed of a porous metal member. Thus, the working fluid led into the working fluid chambers is allowed to penetrate into the sprocket through the base part thereby to bring about a sufficient lubrication of a portion where the sprocket and the timing chain are meshed. The porous metal member may be a sintered metal.

14 Claims, 3 Drawing Sheets

VALVE TIMING CONTROL DEVICE OF INTERNAL COMBUSTION ENGINE

BACKGROUND OF THE INVENTION

1. Field of the Invention

The present invention relates to a valve timing control device of an internal combustion engine, that controls or changes open/close timing of intake or exhaust valves under operation of the engine.

2. Description of the Prior Art

Some of the valve timing control devices are of a type that is arranged between a sprocket that is driven by a timing chain in synchronization with the engine rotation and a camshaft that drives intake valves or exhaust valves and arranged to rotate the camshaft in one or the other direction relative to the sprocket thereby to control or change the open/close timing of the valves.

Japanese Patent First Provisional Publication 9-324611 shows a valve timing control device which comprises a sprocket driven by a timing chain in synchronization with the engine rotation, a housing rotated together with the sprocket, a rotor installed in the housing and rotated together with a camshaft, a plurality of radially outward projecting vanes provided on the rotor in a manner to define in the housing a plurality of working fluid chambers and a charging/discharging means for charging and discharging a working fluid to and from the working fluid chambers. By actuating the charging/discharging means, a relative rotation is induced between the housing and the rotor and thus between the camshaft and the sprocket. The sprocket is integral with the housing and they are made of cast iron. The sprocket has on its outer periphery a plurality of teeth with which the timing chain is meshed.

For lubricating the sprocket and the timing chain, the lubrication oil in an oil pan is used. That is, due to rotation of a crankshaft of the engine, the oil in the oil pan is splashed over the sprocket and the timing chain. However, this oil application method has failed to obtain satisfied oil lubrication at the portion where the sprocket and the timing chain are meshed.

SUMMARY OF THE INVENTION

It is therefore an object of the present invention to provide a valve timing control device of an internal combustion engine, which assures satisfied oil lubrication at the portion where the sprocket and the timing chain are meshed.

According to a first aspect of the present invention, there is provided a valve timing control device for use in an internal combustion engine. The engine comprises a sprocket driven by a timing chain in synchronization with the engine rotation and a camshaft for driving engine valves. The valve timing control device comprises a first rotating member on which the sprocket is integrally formed; a second rotating member capable of making a relative rotation to the first rotating member, the second rotating member being rotated together with the camshaft; a plurality of working fluid chambers defined between the first and second rotating members; and a working fluid actuator for charging and discharging a working fluid to and from said working fluid chambers to induce the relative rotation between the first and second rotating members, in which the sprocket and at least a base part of the first rotating member on which the sprocket is integrally formed are constructed of a porous metal member, so that the working fluid led into the working fluid chambers is allowed to penetrate into the sprocket through the base part.

According to a second aspect of the present invention, there is provided a valve timing control device for use in an internal combustion engine. The engine comprises a sprocket driven by a timing chain in synchronization with the engine rotation and a camshaft for driving engine valves. The valve timing control device controls open/close timing of the valves by varying a relative rotation between the sprocket and the camshaft. The valve timing control device comprises a first rotating member on which the sprocket is integrally formed; a second rotating member concentrically received in the first rotating member in a manner to make a relative rotation therebetween, the second rotating member being rotated together with the camshaft; a plurality of working fluid chambers defined between the first and second rotating members; and a charging/discharging means for charging and discharging a working fluid to and from the working fluid chambers to induce the relative rotation between the first and second rotating members, in which the sprocket is arranged to surround the working fluid chambers, and the sprocket and at least a base part of the first rotating member on which the sprocket is integrally formed are constructed of a porous sintered metal, so that a working fluid led into the working fluid chambers is allowed to penetrate into the sprocket through the base part.

According to a third aspect of the present invention, there is provided a valve timing control device for use in an internal combustion engine. The engine comprises a sprocket driven by a timing chain in synchronization with the engine rotation and a camshaft for driving engine valves. The valve timing control device controls open/close timing of the valves by varying a relative rotation between the sprocket and the camshaft and comprises a cylindrical housing on which the sprocket is integrally formed; a vane member concentrically received in the cylindrical housing in a manner to make a relative rotation therebetween, the vane member being rotated together with the camshaft and comprising a plurality of vanes; a plurality of working fluid chambers defined between the cylindrical housing and the vanes of the vane member; and a working fluid actuator for charging and discharging a working fluid to and from the working fluid chambers to induce the relative rotation between the cylindrical housing and the vane member, in which the sprocket is arranged to surround the working fluid chambers, and the sprocket and at. least a base part of the cylindrical housing on which the sprocket is integrally formed are constructed of a porous sintered metal, so that a working fluid led into the working fluid chambers is allowed to penetrate into the sprocket through the base part.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings.

For ease of understanding, various directional terms, such as right, left, upper, lower, rightward, etc., are used in the description. However, it is to be noted that such terms are to be understood with respect to a drawing or drawings on which corresponding part or portion is illustrated.

Figure 1:
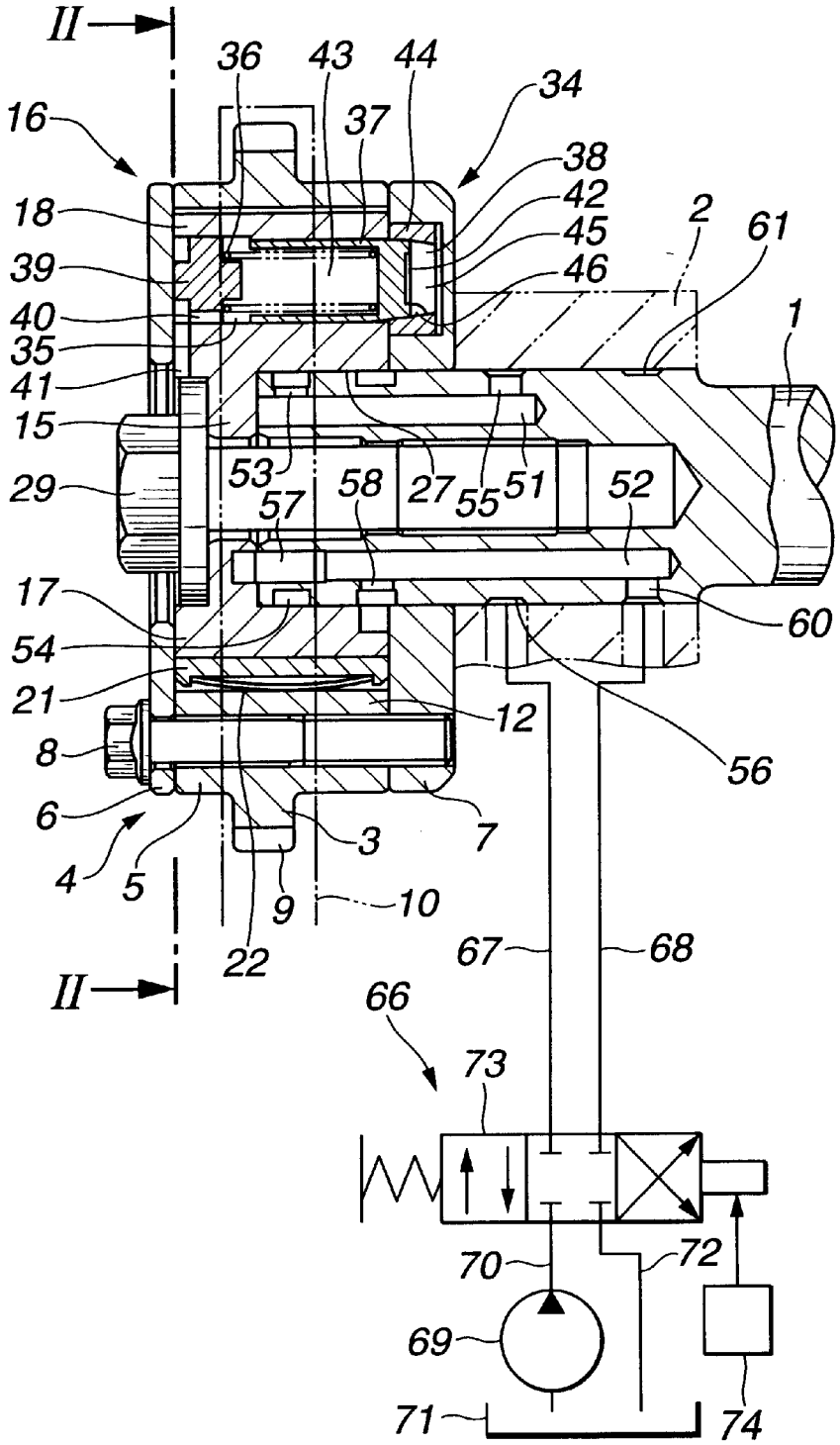
FIG. 1 is a sectional view of a valve timing control device of the present invention.

Referring to FIG. 1, there is shown in a sectional manner a valve timing control device of the present invention.

In the drawing, denoted by numeral 1 is a camshaft that is rotatably mounted on an engine proper (not shown) for actuating intake valves. Of course, the camshaft 1 may be of a type that actuates exhaust valves.

As shown, the camshaft 1 is rotatably supported by a bearing 2 that is fixed to a cylinder head (not shown) of the engine. The camshaft 1 is formed at its major portion (not shown) with a plurality of cams for actuating the intake valves.

The camshaft 1 is driven by a sprocket 3 that is driven in synchronization with the rotation of the engine. As shown, the sprocket 3 is arranged coaxial with the camshaft 1.

For the following reason, the sprocket 3 rotates together with a cylindrical housing 4, and for the reason that will be described hereinafter, the sprocket 3 can rotate or pivot about its axis by a predetermined angle relative to the cam shaft 1.

The sprocket 3 is integrally formed on the cylindrical housing 4. That is, the housing 4 comprises a cylinder member 5 which has the sprocket 3 integrally formed thereabout and left and right circular plate members 6 and 7 which close left and right open ends of the cylinder member 5.

Figure 2:
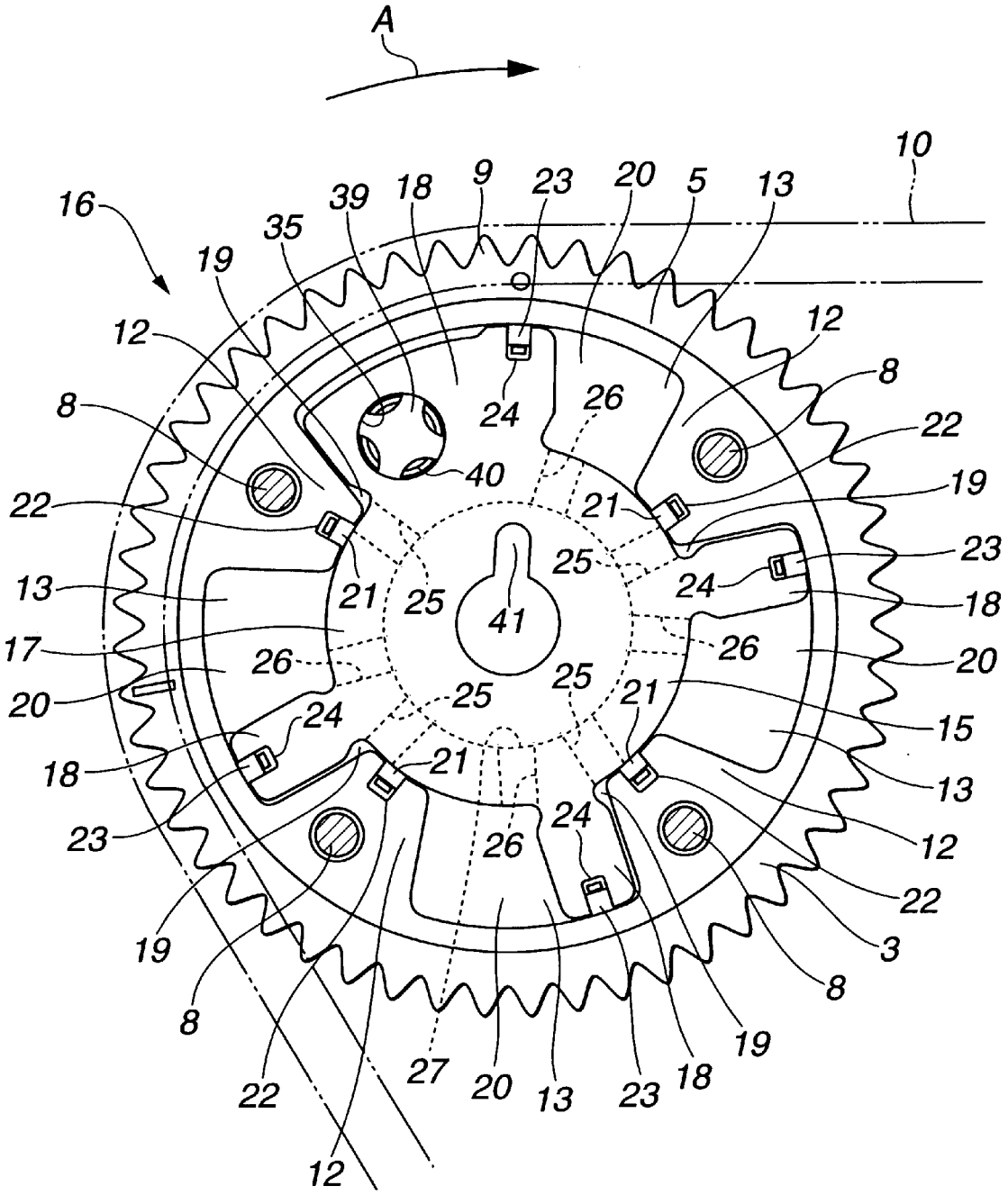
FIG. 2 is a sectional view taken along the line II—II of FIG. 1, with a center bolt removed.

As is seen from FIGS. 1 and 2, the cylinder member 5 and the two circular plate members 6 and 7 are assembled and united by four bolts 8. The sprocket 3 is formed therearound a plurality of external teeth 9 with which a timing chain 10 (see FIG. 2) is operatively meshed. Although not shown in the drawing, the timing chain 10 is driven by a crankshaft of the engine.

As is seen from FIG. 1, the sprocket 3 is positioned somewhat left with respect to an axial center of the entirety of the cylindrical housing 4. For this positioning, the sprocket 3 is formed on a base part of the cylinder member 5, that is nearer to the left plate member 6 than the right plate member 7, and the left plate member 6 is formed thinner than the right plate member 7. Thus, as a whole, the sprocket 3 is positioned somewhat left, that is, away from the camshaft 1 with respect to the axial center of the entirety of the cylindrical housing 4. If desired, the sprocket 3 may be arranged on the cylinder member 5 at or near the axial center of the cylinder member 5. In this case, the right plate member 7 should be much thicker than the left plate member 6, so that as a whole the sprocket 3 is positioned away from the camshaft 1 with respect to the axial center of the entirety of the cylindrical housing 4.

The unit consisting of the sprocket 3 and the cylinder member 5 is constructed of a sintered metal, and the left and right plate members 6 and 7 are constructed of a steel plate or the like. In other words, the unit consisting of the sprocket 3 and the cylinder member 5 is constructed of a porous metal member and the left and right plate members 6 and 7 are constructed of a non-porous metal member.

As is seen from FIG. 2, within the cylindrical housing 4, there are provided four projections 12 that project radially inward from the cylinder member 5. With these four projections 12, four chambers 13 are defined in the cylindrical housing 4, that are connected at a center portion.

Within the cylindrical housing 4, there is further installed a vane member 15 that can rotate about its axis by a predetermined angle relative to the housing 4. This vane member 15 and the cylindrical housing 4 constitute an essential part of a relative rotation means 16 which will be described hereinafter.

As shown in FIG. 2, the vane member 15 comprises a circular base portion 17 and four vanes 18 that extend radially outward from the base portion 17. These vanes 18 are loosely put in the four chambers 13 respectively as shown. Thus, due to presence of the vane 18, each chamber 13 defines therein a pair of working fluid chambers 19 and 20. That is, between the cylindrical housing 4 and the vane member 15, there are defined four pairs of working fluid chambers 19 and 20.

As shown, each inward projection 12 of the cylinder member 5 has a recess (no numeral) at a leading end thereof. Within the recess, a seal member 21 biased by a spring 22 is installed. Thus, the seal member 21 is pressed against the circular base portion 17 of the vane member 15 to achieve a sealing therebetween. Furthermore, each vane 18 of the vane member 15 has a recess (no numeral) at a leading end thereof. Within the recess, a seal member 23 biased by a spring 24 is installed. Thus, the seal member 23 is pressed against the inner wall of the cylinder member 5 to achieve a sealing therebetween. Thus, the paired working fluid chambers 19 and 20 are hermetically isolated from each other.

As is seen from FIG. 2, the vane member 15 is formed with four first passages 25 that extend to the working fluid chambers 19 and four second passages 26 that extend to the other working fluid chambers 20. Furthermore, the vane member 15 is formed with an axially extending bore 27 to which the first and second passages 25 and 26 are exposed. The first and second passages 25 and 26 of each pair are provided at different positions that are spaced from each other in an axis direction of the bore 27.

Accordingly, by charging or discharging a working fluid to or from the working fluid chambers 19 and 20 through the first and second passages 25 and 26, a relative rotation takes place between the cylindrical housing 4 and the vane member 15.

As shown in FIG. 1, the vane member 15 is axially connected to the camshaft 1. That is, a left end of the camshaft 1 is intimately put in the bore 27 of the vane member 15, and as is seen from FIGS. 1 and 3, by means of a center bolt 29 that passes axially through the circular base portion 17 of the vane member 15, the two members 1 and 15 are secured.

As has been mentioned hereinabove, the sprocket 3 is provided on the cylindrical housing 4, and the vane member 15 fixed to the camshaft 1 is arranged to make a rotation relative to the cylindrical housing 4. Accordingly, by charging or discharging a working fluid to or from the working fluid chambers 19 and 20 through the first and second passages 25 and 26, the cylindrical housing and the vane member 15 can make a relative rotation in a predetermined angular range. Thus, the cylindrical housing 4 and the vane member 15 constitute an essential part of a relative rotation means 16 that allows the sprocket 3 to make a rotation relative to the camshaft 1.

As is seen from FIG. 1, between the cylindrical housing 4 and the vane member 15, there is provided a rotation restricting means 34 that restricts the relative rotation between the housing 4 and the vane member 15. The rotation restricting means 34 comprises an axially extending cylindrical bore 35 formed in the vane member 15, an engaging pin 37 slidably received in the bore 35, a spring 36 received in the bore 35 to bias the engaging pin 37 to project rightward from the bore 35 and an engaging opening 38 formed in the right plate member 7 of the cylindrical housing 4 to catch the engaging pin 37. That is, when the relative rotation between the cylindrical housing 4 and the vane member 15 exceeds the predetermined angle and thus the spring-biased engaging pin 37 comes to a position to face the engaging opening 38 of the housing 4, the pin 37 is pushed into the opening 38 due to the force of the spring 36 thereby to establish a latched engagement between the two members 4 and 15.

As is seen from FIG. 2, the cylindrical bore 35 is formed in and through the largest one of the vanes 18 of the vane member 15. As is seen from FIG. 1, a left open end of the cylindrical bore 35 has a spring seat 39 press-fitted therein for seating the spring 36. Preferably, the spring seat 39 is constructed of a metal that is harder than the vane 18.

As is seen from FIGS. 1 and 2, the spring seat 39 has thereabout four cuts 40 that serve as air bleeder. That is, the cuts 40 are communicated with a radially extending groove 41 that is formed on a side face of the circular base portion 17 of the vane member 15. Thus, as is seen from FIG. 1, the interior of the cylindrical bore 35 located behind the pin 37 is communicated with the open air through the cuts 40 and the groove 41.

As is seen from FIG. 1, the right or leading end of the spring-biased pin 37 is tapered for facilitation of insertion into the engaging opening 38. Furthermore, the leading end of the pin 37 is formed with a recess 42, and the pin 37 is formed with a blind bore 43 that receives the spring 36. Due to provision of the recess 42 and blind bore 43, a certain weight reduction of the pin 37 is achieved. The engaging opening 38 is formed in a collar member 44 press-fitted in a bore formed in the right circular plate member 7 of the housing 4. Preferably, the collar member 44 is made of a metal that is harder than the plate member 7.

As shown in FIG. 1, the engaging opening 38 is in the form of cup having a larger diameter mouth portion. A bottom portion of the engaging opening 38 forms a fluid chamber 45 when the engaging pin 37 becomes mated with the opening 38. The opening 38 is communicated with working fluid chamber 19 through a fluid passage 46 formed through the plate member 7 and the collar member 44.

Figure 3:
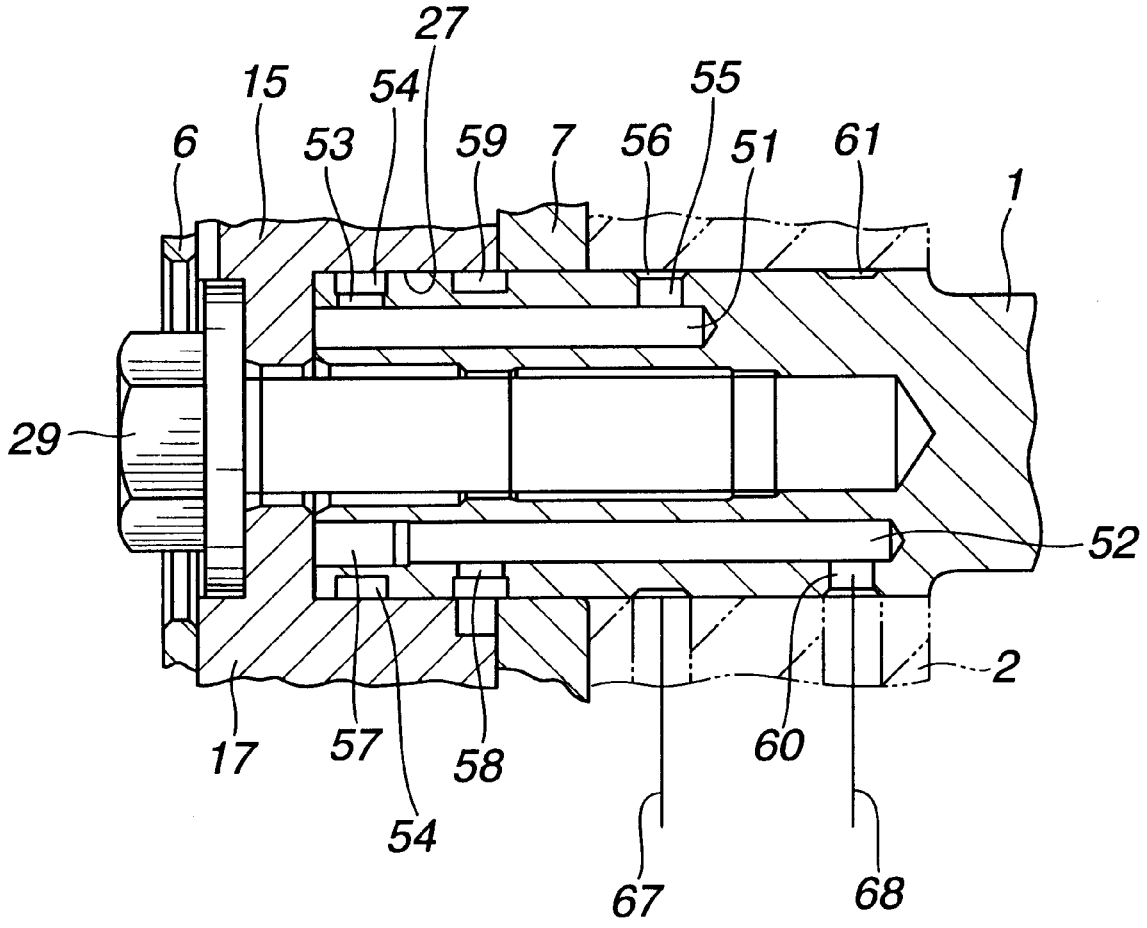
FIG. 3 is an enlarged sectional view of a center part of the valve timing control device of the invention.

As is seen from FIGS. 1 and 3, the camshaft 1 is formed with first and second fluid pressure passages 51 and 52 that extend in an axial direction. These first and second fluid pressure passages 51 and 52 are communicated with the above-mentioned first and second passages 25 and 26 respectively and communicated with a fluid charging/discharging means 66 which will be described hereinafter.

That is, as is best seen from FIG. 3, the first fluid pressure passage 51 is a blind bore that extends axially from a left end of the camshaft 1. The left open end of the passage 51 is closed by a bottom wall of the bore 27 of the vane member 15. The passage 51 is formed near its left open end with a radially extending first branch passage 53. The first branch passage 53 is exposed to a first annular groove 54 that is formed around the camshaft 1. Thus, through the first branch passage 53 and the first annular groove 54, the first fluid pressure passage 51 is communicated with the four first passages 25 of the vane member 15. Furthermore, the passage 51 is formed behind the first branch passage 53 with a radially extending second branch passage 55. The second branch passage 55 is exposed to a second annular groove 56 that is formed around the camshaft 1. Through the second branch passage 55 and the second annular groove 56, the first fluid pressure passage 51 is communicated with the after-mentioned fluid charging/discharging means 66.

The second fluid pressure passage 52 is also a blind bore that extends axially from the left end of the camshaft 1. The left open end of the passage 52 is closed by the bottom wall of the bore 27 of the vane member 15, as shown. The passage 52 is formed near its left open end (more specifically, behind the above-mentioned first branch passage 53) with a radially extending third branch passage 58. The third branch passage 58 is exposed to a third annular groove 59 that is formed around the camshaft 1. Thus, through the third branch passage 58 and the third annular groove 59, the second fluid pressure passage 52 is communicated with the four second passages 26 of the vane member 15. Furthermore, the passage 52 is formed neat its blind end with a radially extending fourth branch passage 60. The fourth branch passage 60 is exposed to a fourth annular groove 61 that is formed around the camshaft 1. Through the fourth branch passage 60 and the fourth annular groove 61, the second fluid pressure passage 52 is communicated with the after-mentioned fluid charging/discharging means 66.

As is seen in FIG. 1, the fluid charging/discharging means 66 comprises a first charging/discharging passage 67 communicated with the first fluid pressure passage 51, a second charging/discharging passage 68 communicated with the second fluid pressure passage 52, an oil pump 69 for pumping up a working fluid from a reservoir tank 71 and an electromagnetic switching valve 73 interposed between the oil pump 69 and each of the first and second charging/discharging passages 67 and 68. That is, due to the switching operation of the switching valve 73, either one of the first and second charging/discharging passages 67 and 68 is connectable with one of charging and discharging passages 70 and 72. For controlling the operation of the switching valve 73, a control device 74 is employed. The switching valve 73 used in the illustrated embodiment is of a four port type. For controlling the valve 73, the control device 74 receives and processes a plurality of signals that represent the operation condition of the engine.

Operation will be described in the following.

When, due to cold starting of the engine, the oil pump 69 fails to output a sufficient amount of working fluid or when the control device 74 is receiving a signal that instructs the engine to operate at the most delayed timing, the vane member 15 of the relative rotation means 16 assumes a most-delayed angular position relative to the cylindrical housing 4, as is seen from FIG. 2 wherein the engaging pin 37 of the rotation restricting means 34 is engaged with the engaging opening 38. Thus, under this condition, the housing 4 and the vane member 15 act as a single unit. Thus, the torque applied to the sprocket 3 from the timing chain 10 is transmitted to the camshaft 1 through the tightly coupled housing 4 and vane member 15. As is seen from FIG. 2, under this condition, the vanes 18 of the vane member 15 do not contact side walls of the corresponding projections 12 of the housing 4. Due to rotation of the camshaft 1 thus induced, the intake valves are actuated to open and close intake openings of the combustion chambers.

When the vane member 15 assumes the most-delayed angular position relative to the housing 4, the engaging pin 37 is engaged with the engaging opening 38 and thus, as is mentioned hereinabove, relative rotation between the vane member 15 and the housing 4 is suppressed. Accordingly, even when, during actuation of the intake valves by the camshaft 1, the camshaft 1 is applied with a positive or negative reversed torque, undesired noises that would be caused by striking of the vanes 18 against the side walls of the projections 12 are suppressed.

For advancing the angular position of the vane member 15 relative to the housing 4, the control device 74 forces the switching valve 73 to switch to another position where the charging passage 70 connects to the first charging/discharging passage 67 and at the same time the discharging passage 72 connects to the second charging/discharging passage 68. With this, the pressurized working fluid from the oil pump 69 is led into the working fluid chambers 19 through the second annular groove 56, the second branch passage 55, the first fluid pressure passage 51, the first branch passage 53, the first annular groove 54 and the four first passages 25. The pressurized working fluid led into the working fluid chambers 19 is led into the fluid chamber 45 of the engaging opening 38 through the fluid passage 46 formed through the plate member 7 and the collar member 44.

At the same time, the other working fluid chambers 20 become communicated with the discharging passage 72 through the four second passages 26, the third annular groove 59, the third branch passage 58, the second fluid pressure passage 52, the fourth branch passage 60, the fourth annular groove 61 and the second charging/discharging passage 68.

Due to application of the pressurized working fluid to the working fluid chambers 19 and the fluid chamber 45 of the engaging opening 38, the engaging pin 37 is biased by the working fluid leftward in FIG. 1, that is, in a direction against the force of the spring 36, and finally the engaging pin 37 is fully received in the bore 35 of the vane member 15. Thus, the engaging pin 37 becomes disengaged from the engaging opening 38 canceling the latched engagement between the housing 4 and the vane member 15. Thus, thereafter, these two members 4 and 15 are permitted to make a relative rotation therebetween.

Due to feeding the pressurized working fluid to the working fluid chambers 19 and establishing the connection of the working fluid chambers 20 to the discharging passage 72, the hydraulic pressure in the working fluid chambers 19 is applied to the side walls of the vanes 18, so that the vane member 15 is rotated or pivoted in the direction of the arrow A in FIG. 2 relative to the cylindrical housing 4, that is, in an angular position advancing direction. With this, the sprocket 3 and the camshaft 1 are forced to make a relative rotation therebetween to change the rotational phase of the camshaft 1 relative to a crankshaft (not shown). That is, the camshaft 1 becomes advanced in operation and thus the open/close timing of the intake valves is advanced.

When, as is described hereinabove, the camshaft 1 is advanced in operation and the vane member 15 takes the most advanced angular position relative to the housing 4, the engaging pin 37 is kept pressed back to the cylindrical bore 35 due to the hydraulic pressure in the working fluid chambers 19. Thus, under this condition, the engaging pin 37 does not contact the left circular plate member 6 of the housing 4.

When now due to instruction by the control device 74, the switching valve 73 is forced to switch, another mode is established wherein the second charging/discharging passage 68 is connected with the charging passage 70 and at the same time the first charging/discharging passage 67 is connected with the discharging passage 72. Upon this, the pressurized working fluid from the oil pump 69 is led into the other working fluid chambers 20 through the fourth annular groove 61, the fourth branch passage 60, the second fluid pressure passage 52, the third branch passage 58, the third annular groove 59 and the four second passages 26. At the same time, the working fluid in the working fluid chambers 19 is discharged into the reservoir tank 71 through the four first passages 25, the first annular groove 54, the first branch passage 53, the first fluid pressure passage 51, the second branch passage 55, the second annular groove 56, the first charging/discharging passage 67 and the discharging passage 72.

Due to discharging of the working fluid from the working fluid chambers 19, the engaging pin 37 is mainly biased by the spring 36. However, since under this condition the engaging pin 37 is not in alignment with the engaging opening 38, the unlatched condition between the housing 4 and the vane member is maintained. That is, the rotation restricting means 34 keeps these two members 4 and 15 unlatched.

Because the working fluid chambers 20 are supplied with the pressurized working fluid and the other working fluid chambers 19 are forced to discharge the fluid therefrom, the hydraulic pressure in each fluid chambers 20 is applied to the side wall of the corresponding vane 18, and thus, the vane member 15 is rotated or pivoted in a counterclockwise direction in FIG. 2 relative to the housing 4, that is, in a timing delaying direction. With this, the sprocket 3 and the camshaft 1 are forced to make another relative rotation thereby to change the rotational phase of the camshaft 1 relative to the crankshaft (not shown). That is, the camshaft 1 becomes delayed in operation and thus the open/close timing of the intake valves is delayed.

When, as is described hereinabove, the camshaft 1 is delayed in operation and the vane member 15 takes the most delayed angular position relative to the housing 4, the engaging pin 37 becomes in alignment with the engaging opening 38 and thus engaged with the opening 38 due to the force of the spring 36. Thus, the latched condition between the housing 4 and the vane member 15 is established again.

When, during the time when the vane member 15 is rotating in a timing advancing or delaying direction relative to the housing 4, the switching valve 73 is forced to switch the fluid line and thus the connection between one of the first and second charging/discharging passages 67 and 68 and one of the charging and discharging passages 70 and 72 is blocked, the vane member 15 is forced to stop at an intermediate angular position relative to the housing 4. With this, the sprocket 3 and the camshaft 1 are forced to take an intermediate or desired relative positioning therebetween and thus the camshaft 1 controls the intake valves at a desired open/close timing.

During this, the working fluid chambers 19 are kept hermetically closed with a certain pressure, and thus the force of the spring 36 is applied to the engaging pin 37. However, since the engaging pin 37 is not aligned with the engaging opening 38, the unlatched condition between the housing 4 and the vane member 15 is maintained. That is, the rotation restricting means 34 keeps these two members 4 and 15 unlatched.

As has been described hereinabove, in accordance with the present invention, the unit of the sprocket 3 and the cylinder member 5 is constructed of a sintered metal. Furthermore, the sprocket 3 integrally formed on the cylindrical housing 4 is arranged at a radially outer side of the working fluid chambers 19 and 20. Accordingly, with the aid of pressure in the working fluid chambers 19 and 20, the working fluid led into these chambers 19 and 20 penetrates into the porous structure, that is, sintered metal of the sprocket 3. The fluid penetration is promoted when. a centrifugal force is applied to the working fluid due to rotation of the relative rotation means 16. Accordingly, the portion where the sprocket 3 and the timing chain 10 are operatively meshed is sufficiently and effectively lubricated by the fluid.

In the following, advantages of the present invention will be described.

First, the lubrication between the sprocket 3 and the timing chain 10 is sufficiently carried out for the reasons as has been just mentioned hereinabove.

Second, since the sprocket 3 on the cylinder member 5 is positioned away from the camshaft 1 with respect to the axial center of the entirety of the cylindrical housing 4, undesired whirling of the sprocket 3 is suppressed, which would be caused by out of centering and unbalanced arrangement of the incorporated parts. That is, in the valve timing control device, the vane member 15 is fixed to the leading end of the camshaft 1. Thus, if such out of centering and unbalanced arrangement are present, such undesired whirling tends to occur. However, in the present invention, the timing chain 10 meshed to the sprocket 3 applies a force of constraint to the valve timing control device at a position that is far from the camshaft 1. In other words, the tension of the timing chain 10 serves as the force of constraint against the whirling. Thus, the undesired whirling is suppressed or at least minimized.

Third, the cylindrical housing 4 comprises the cylinder member 5 which has the sprocket 3 integrally formed thereabout and left and right circular plate members 6 and 7 which close left and right open ends of the cylinder member 5, and the sprocket 3 is formed on the cylinder member 5 at a generally axial center of the cylinder member 5. Thus, the cylinder member 5 with the sprocket 3 is easily produced. That is, the unit consisting of these two members 5 and 3 has a symmetrical structure with respect to the center axis, which simplifies the structure of a mold for shaping a green body of the sintered unit as well as the process of casting the sintered unit.

Fourth, in the cylindrical housing 4, only the sprocket 3 and the cylinder member 5 on which the sprocket 3 is integrally formed are constructed of a porous sintered metal. Thus, the working fluid in the working fluid chambers 19 and 20 is permitted to penetrate into only the sprocket 3 and the cylinder member 5, which induces concentrated and enhanced lubrication of the portion where the sprocket 3 and the timing chain 10 are meshed.

Fifth, the vane member 15 is rotatably or pivotally received in the cylindrical housing 4 and has a plurality of radially outwardly projecting vanes 18 that define in the housing 4 a plurality of working fluid chambers 19 and 20. This induces that the working fluid chambers 19 and 20 have each a larger length in an axial direction, and thus the sprocket 3 has a sufficient freedom in positioning in the axial direction.

In the following, a modification of the present invention will be described.

That is, the cylindrical housing 4 and the vane member 15 are connected through a helical gear. A plurality of working fluid chambers are defined between the housing 4 and the vane member 15 to actuate the helical gear. Thus, in this modification, the rotation of the helical gear in one-and-the other directions actuated by the working fluid induces the relative rotation between the housing 4 and the vane member 15.

The entire contents of Japanese Patent Application P11-284270 (filed Oct. 5, 1999) are incorporated herein by reference.

Although the invention has been described above with reference to the embodiment of the invention, the invention is not limited to the embodiment described above. Various modifications and variations of the embodiment described above will occur to those skilled in the art, in light of the above teachings.

What is claimed is:

1. In an internal combustion engine comprising a sprocket driven by a timing chain in synchronization with the engine rotation and a camshaft for driving engine valves, a valve timing control device comprising:

a first rotating member on which said sprocket is integrally formed;

a second rotating member capable of making a relative rotation to said first rotating member, said second rotating member being rotated together with said camshaft;

a plurality of working fluid chambers defined between said first and second rotating members; and a working fluid actuator for charging and discharging a working fluid to and from said working fluid chambers to induce the relative rotation between said first and second rotating members, in which said sprocket and at least a base part of said first rotating member on which said sprocket is integrally formed are constructed of a porous metal member, so that the working fluid led into the working fluid chambers is allowed to penetrate into said sprocket through said base part.

2. A valve timing control device as claimed in claim 1, in which said porous metal member is a sintered metal.

3. A valve timing control device as claimed in claim 1, in which said sprocket is arranged to surround said working fluid chambers.

4. A valve timing control device as claimed in claim 3, in which said sprocket is positioned away from said camshaft with respect to an axial center of said first rotating member.

5. A valve timing control device as claimed in claim 3, in which said first rotating member comprises a cylinder member on which said sprocket is integrally formed, said sprocket being positioned at a generally axial center of said cylinder member.

6. A valve timing control device as claimed in claim 5, in which said first rotating member further comprises:

a first circular plate member that closes one open end of said cylinder member; and a second circular plate member that closes the other open end of said cylinder member, said second circular plate member being positioned nearer to said camshaft than said first circular plate member.

7. A valve timing control device as claimed in claim 5, in which said second rotating member comprises a vane member rotatably received in the cylinder member of said first rotating member, said vane member including a plurality of vanes that define said working fluid chambers respectively.

8. A valve timing control device as claimed in claim 6, in which the thickness of said second circular plate member is greater than that of said first circular plate member.

9. A valve timing control device as claimed in claim 8, further comprising a rotation restricting device that restricts the relative rotation between said first and second rotating members.

10. A valve timing control device as claimed in claim 9, in which said rotation restricting device comprises:

an engaging opening formed in said second circular plate of said first rotating member;

an engaging pin axially movably held by said vane member of said second rotating member, said engaging pin becoming in alignment with said engaging opening when said first rotating member assumes a predetermined angular position relative to said second rotating member; and a spring that biases said engaging pin toward said engaging opening.

11. A valve timing control device as claimed in claim 5, in which only said cylinder member and said sprocket are constructed of the porous sintered metal.

12. A valve timing control device as claimed in claim 5, in which said working fluid chambers are arranged about the axis of said first rotating member and extend radially outward.

13. In an internal combustion engine comprising a sprocket driven by a timing chain in synchronization with the engine rotation and a camshaft for driving engine valves, a valve timing control device for controlling open/close timing of said valves by varying a relative rotation between said sprocket and said camshaft, said valve timing control device comprising:

a first rotating member on which said sprocket is integrally formed;

a second rotating member concentrically received in said first rotating member in a manner to make a relative rotation therebetween, said second rotating member being rotated together with said camshaft;

a plurality of working fluid chambers defined between said first and second rotating members; and a working fluid actuator for charging and discharging a working fluid to and from said working fluid chambers to induce the relative rotation between said first and second rotating members, in which said sprocket is arranged to surround said working fluid chambers, and said sprocket and at least a base part of said first rotating member on which said sprocket is integrally formed are constructed of a porous sintered metal, so that a working fluid led into the working fluid chambers is allowed to penetrate into said sprocket through said base part.

14. In an internal combustion engine comprising a sprocket driven by a timing chain in synchronization with the engine rotation and a camshaft for driving engine valves, a valve timing control device for controlling open/close timing of said valves by varying a relative rotation between said sprocket and said camshaft, said valve timing control device comprising:

a cylindrical housing on which said sprocket is integrally formed;

a vane member concentrically received in said cylindrical housing in a manner to make a relative rotation therebetween, said vane member-being rotated together with said camshaft and comprising a plurality of vanes;

a plurality of working fluid chambers defined between said cylindrical housing and the vanes of said vane member; and a working fluid actuator for charging and discharging a working fluid to and from said working fluid chambers to induce the relative rotation between said cylindrical housing and said vane member, in which said sprocket is arranged to surround said working fluid chambers, and said sprocket and at least a base part of said cylindrical housing on which said sprocket is integrally formed are constructed of a porous sintered metal, so that a working fluid led into the working fluid chambers is allowed to penetrate into said sprocket through said base part.

* * * * *